US005925853A

United States Patent [19]

Miller

[11] Patent Number: 5,925,853

[45] Date of Patent: Jul. 20, 1999

[54] WIRE TWIST CONNECTOR

[76] Inventor: William A. Miller, 125 Meadow Creek Dr., Landisville, Pa. 17538

[21] Appl. No.: 08/933,287

[22] Filed: Sep. 18, 1997

Related U.S. Application Data

[63] Continuation of application No. 08/512,469, Aug. 8, 1995, abandoned.

[51] Int. Cl.[6] ..... H01R 4/22

[52] U.S. Cl. ..... 174/87

[58] Field of Search ..... 174/86, 87, 88 R; 403/214, 396

[56] References Cited

U.S. PATENT DOCUMENTS

| | | | |
|---|---|---|---|
| 2,674,647 | 4/1954 | Dibner | 174/87 |
| 4,049,902 | 9/1977 | De Ronde | 174/87 X |
| 5,260,515 | 11/1993 | Braun, Jr. | 174/87 |
| 5,531,618 | 7/1996 | Market | 174/87 X |

*Primary Examiner*—Kristine Kincaid
*Assistant Examiner*—Chau N. Nguyen
*Attorney, Agent, or Firm*—Chase & Yakimo, L.C.

[57] ABSTRACT

A connection for a plurality of wire ends utilizes a first housing having a conical metal housing embedded therein. A terminal lug assembly is releasably engageable with the first housing and in contact with the metal housing. Upon insertion of an initial twist of the wire ends within the first housing and into the metal housing, rotation of the first housing further twists the wire ends into a first connection in contact with the metal housing. The contact of the terminal lug assembly with the metal housing presents a current flow path from the twisted wire ends to the terminal lug, the latter for connection to a terminal of a downstream component. An end cap is insertable within the first housing in lieu of the terminal lug assembly if only a current flow path through the connected wire ends is desired.

15 Claims, 8 Drawing Sheets

WIRE TWIST CONNECTOR

This application is a continuation of application Ser. No. 08/512,469, filed Aug. 8, 1995, now abandoned.

BACKGROUND OF THE INVENTION

This invention relates to a wire connector and, more particularly, to a connector for twisting at least a pair of wire ends into an electrical connection and selectably connecting these twisted ends to a terminal lug.

The use of a plastic housing which twists the bare ends of first and second electric wires into a current conducting connection is known. Such a device shields the twisted connection and precludes the need for electrical tape or the like. The design of such a device, however, precludes the ability to connect the current running through the twisted wire ends to a downstream component. In such cases, the wire ends must be either connected to the appropriate terminal or crimped to an intermediate terminal lug with the terminal lug then being connected to the component's terminal.

Accordingly, in the latter situation, additional time and accompanying labor expense is involved. Moreover, the possibility of a bad connection increases as the free wire ends must be first attached, such as by crimping, to the terminal lug with the lug then being attached to the component.

In response thereto I have invented a wire connector which gives the user the option to twist the ends of at least a pair of the wire ends into a current conducting connection and to then connect these twisted ends to a downstream terminal lug.

Accordingly, it is a general object of this invention to provide a connector for twisting the bare ends of current-carrying wires and connecting the twisted free ends to a downstream terminal lug.

Still another object of this invention is to provide a connector, as aforesaid, with the downstream terminal lug being selectably and releasably associated with the twisted wire ends.

Another object of this invention is to provide a connector, as aforesaid, having an interior housing which twists the wire ends and transmits the current from the twisted wire ends to the downstream terminal lug.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
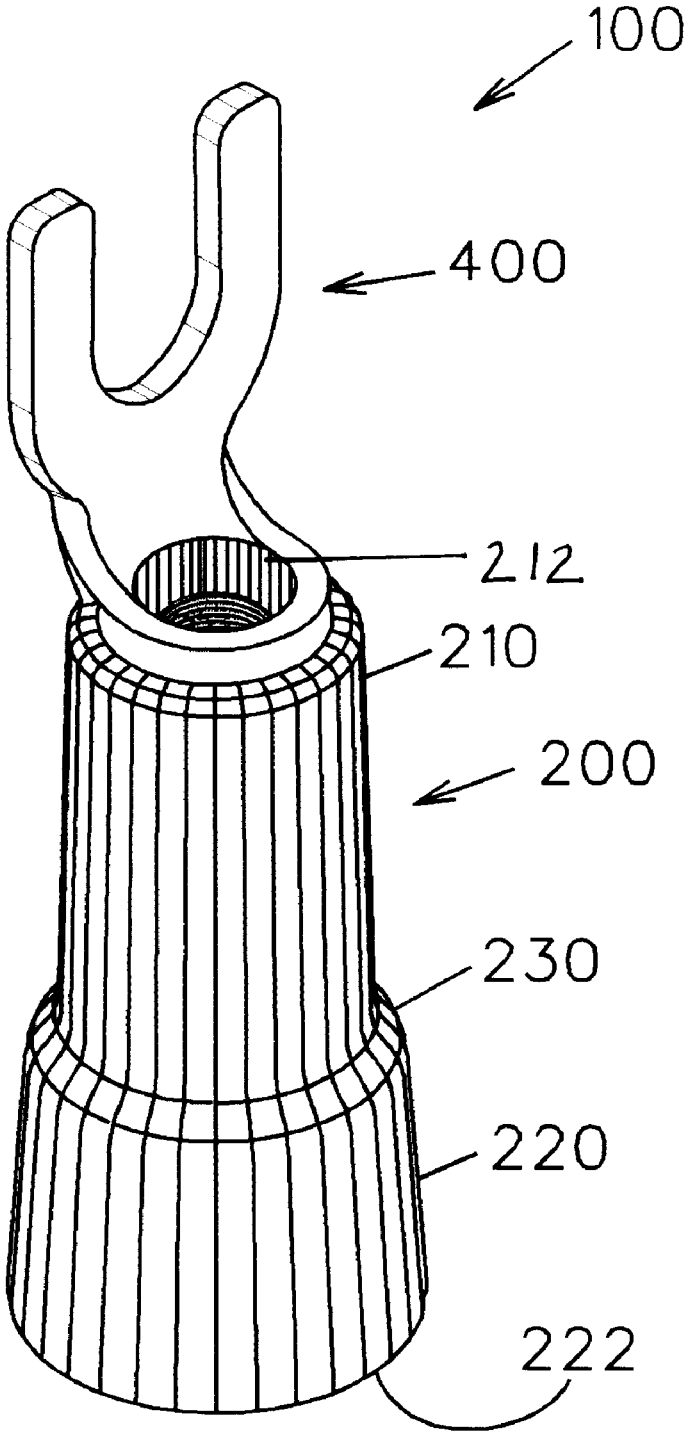
FIG. 1 is a perspective view of the wire twist connector showing a w preferred embodiment of the invention.
Figure 2:
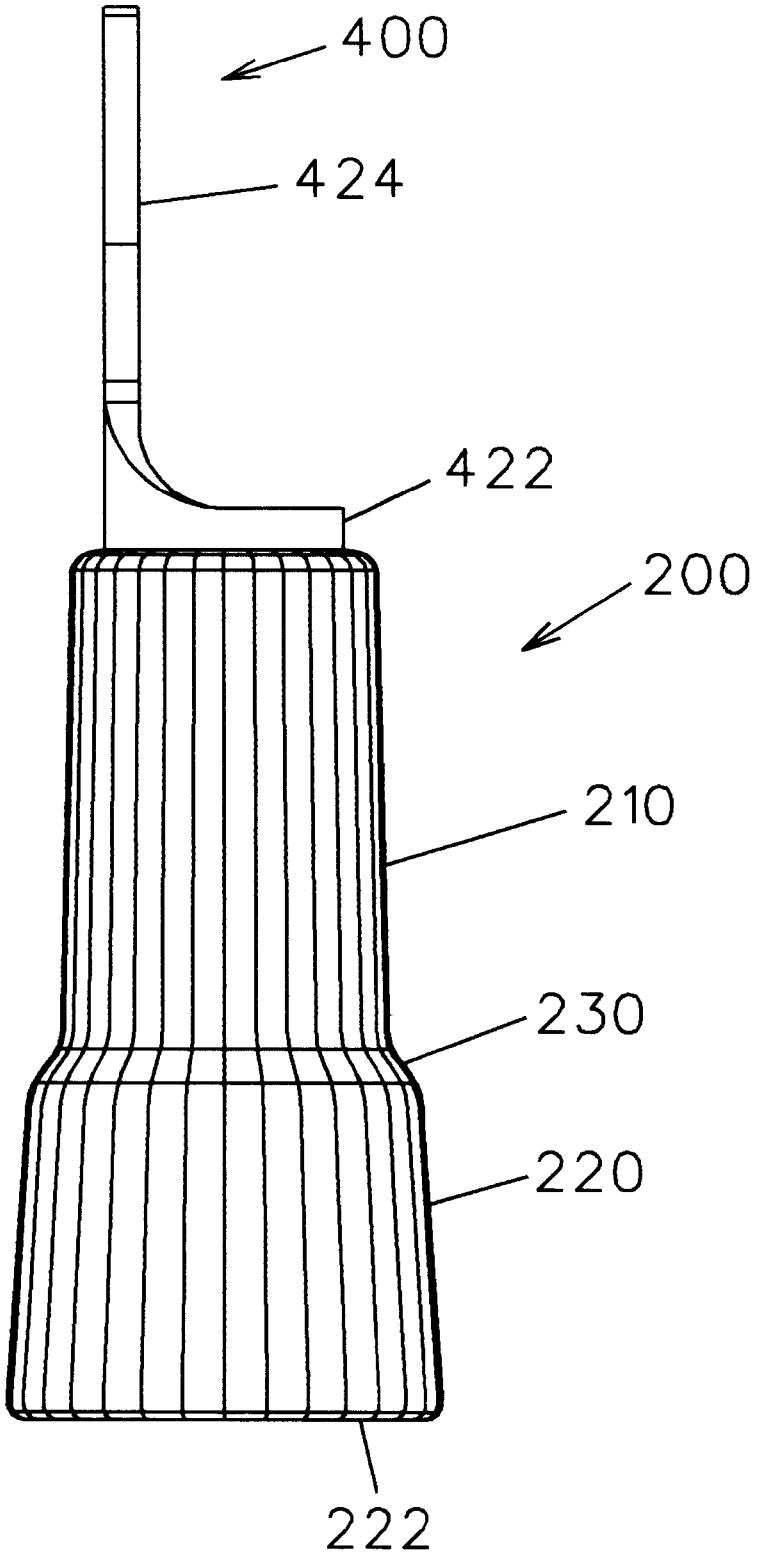
FIG. 2 a side view of the wire twist connector of FIG. 1.
Figure 3:
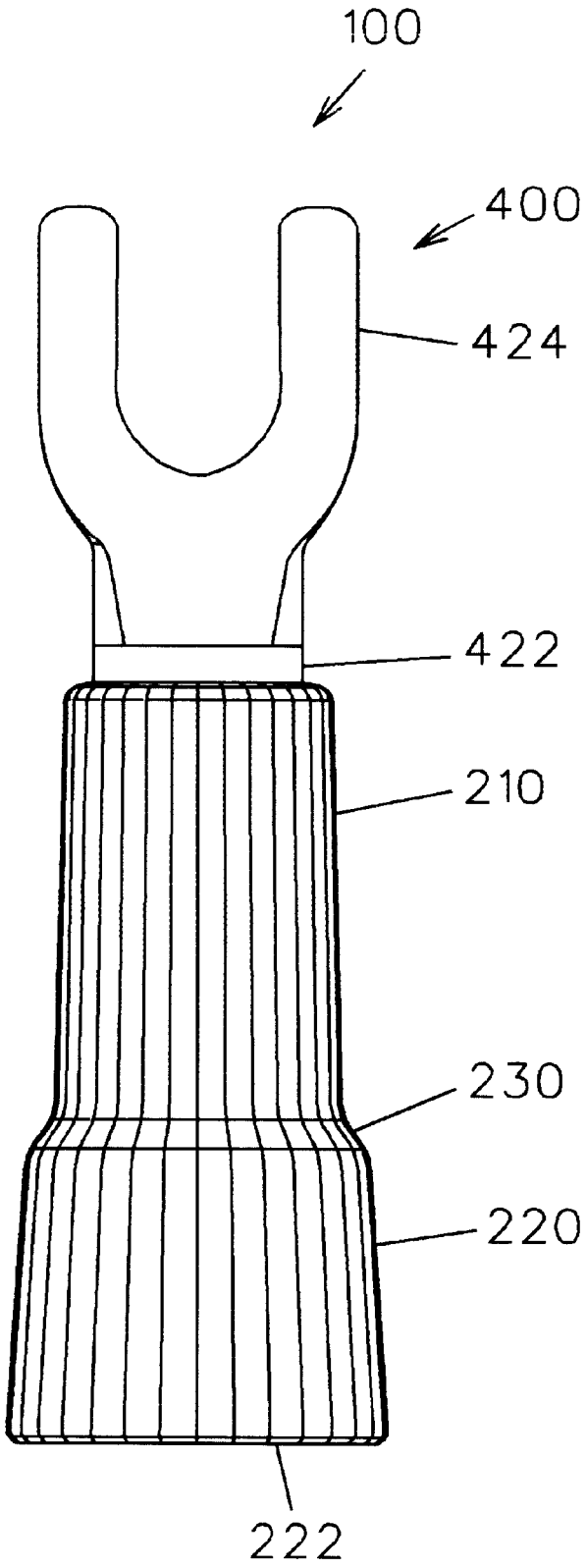
FIG. 3 is a front view of the wire twist connector of FIG. 1.
Figure 4:
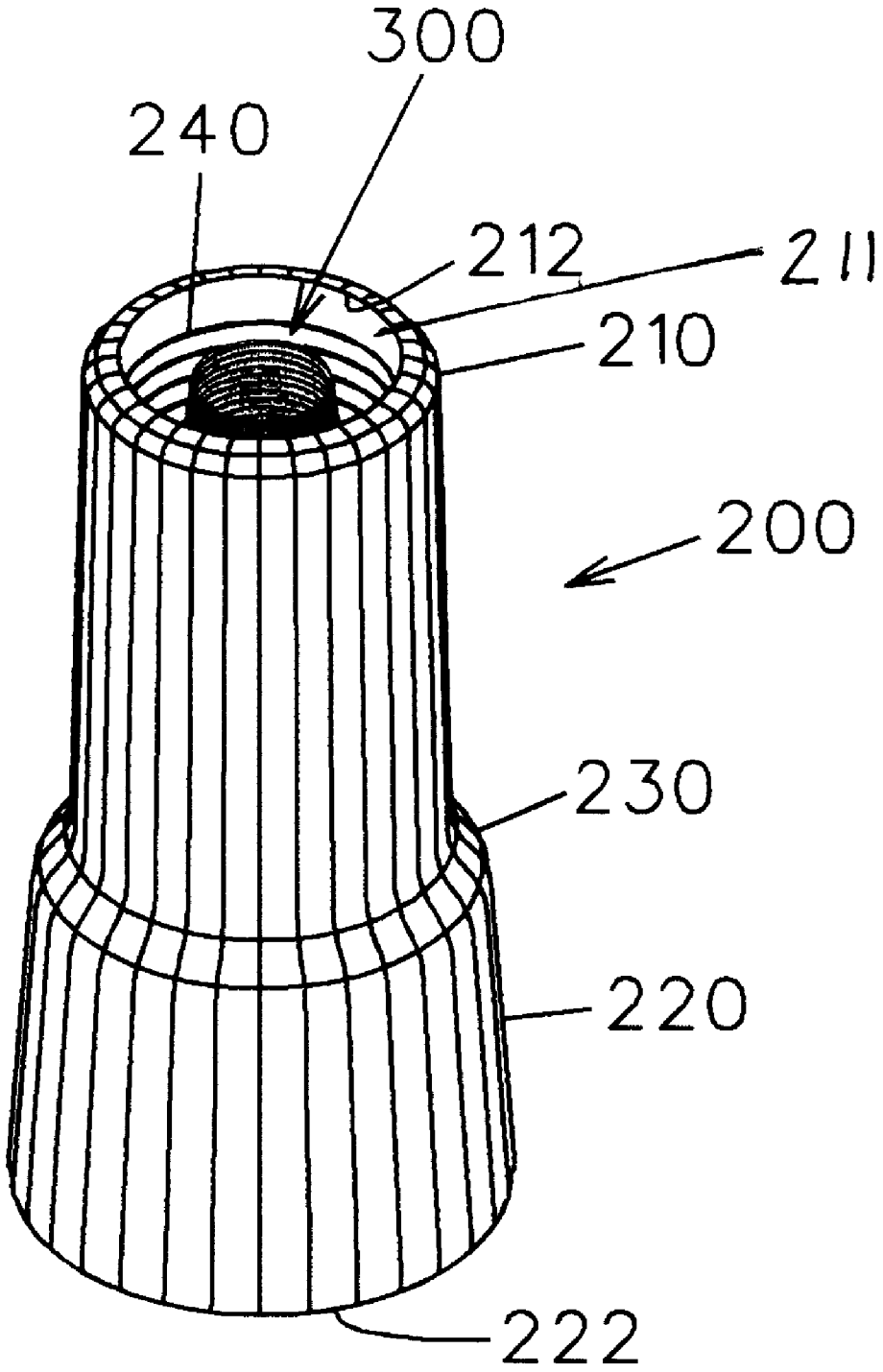
FIG. 4 is a perspective view of the wire twist connector of FIG. 1 with the downstream terminal lug removed.
Figure 5:
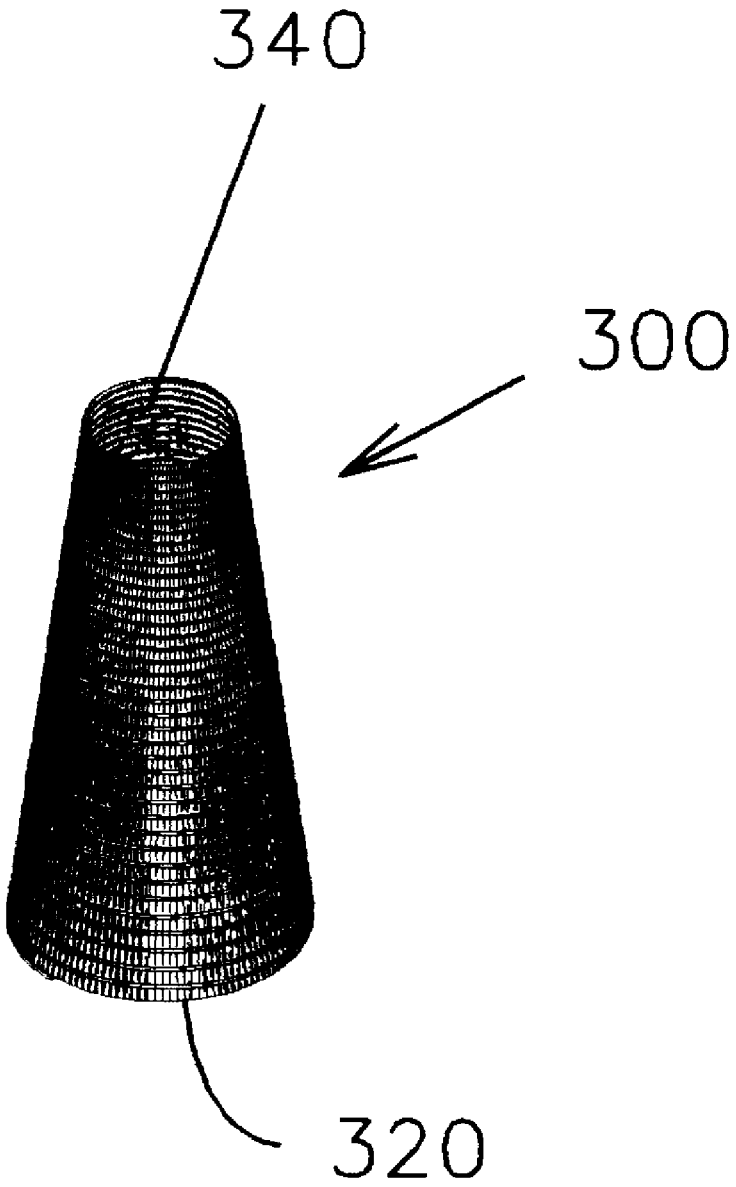
FIG. 5 is a perspective view of the interior housing.
Figure 7:
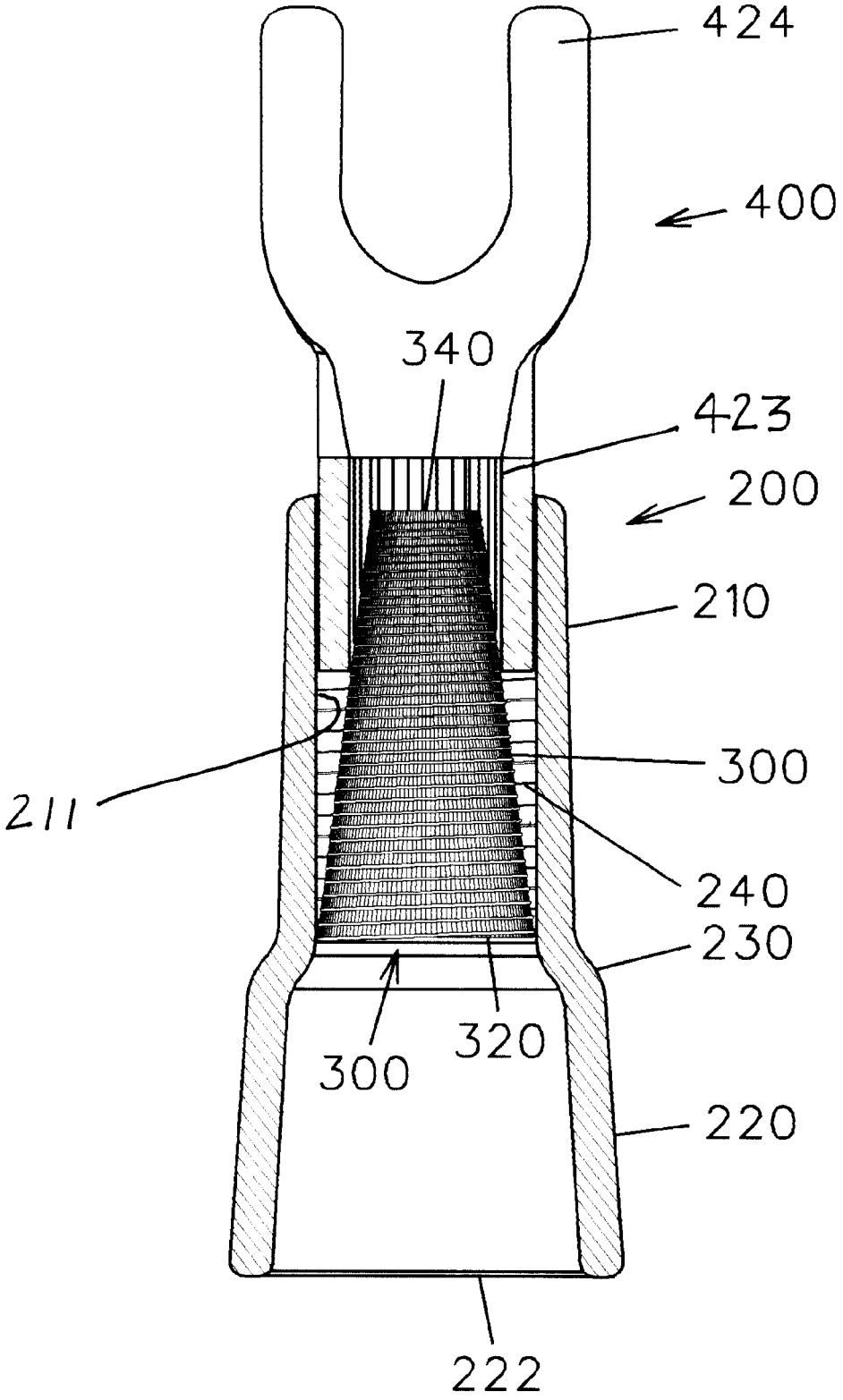
FIG. 7 is a sectional view of the connector, as shown in FIG. 3, showing the connection between the interior wire twist housing and the downs am terminal lug.

Turning more particularly to the drawings, FIGS. 1–3 shows the connector 100 as generally comprising a housing 200 with a terminal lug assembly 400 releasably connected thereto. Located within the housing 200, as shown in FIGS. 5 and 7, is a twist housing 300. Housing 200 generally comprises a first upper cylinder 210 having an aperture 212 (FIG. 4) at the top end thereof. A lower portion 220 presents an opening 222 at its lower end. Bore 211 extends between aperature 212 and opening 222. The upper housing 210 has a reduced diameter, relative to the diameter of the lower housing 220, which presents a shoulder 230 therebetween. Located along the interior face of bore 211 the upper cylinder 210 of housing 200 are a plurality of threads 240 (FIG. 4).

Positioned within the bore 211 of upper cylinder 210 of housing 200 is a twist housing 300 made of a current-conducting metal. The twist housing 300 is preferably conical in configuration which nests within the upper cylinder 210 of housing 200. A space is presented is presented between the threads 240 and the housing 300 as shown above in FIGS. 4 and 7. At least the lower edge 320 of housing 300 engages one of the internal threads 240 to maintain housing 300 within the upper cylinder 210. Housing 300 may be made of various current-conducting metals in a configuration as shown in U.S. Pat. No. 5,260,515. As such, a plurality of coil turns of the housing 300 will further engage the interior threads 240 of the upper cylinder 210. The twist housing 300 presents a lower opening 320 and an upper opening 340.

Figure 6:
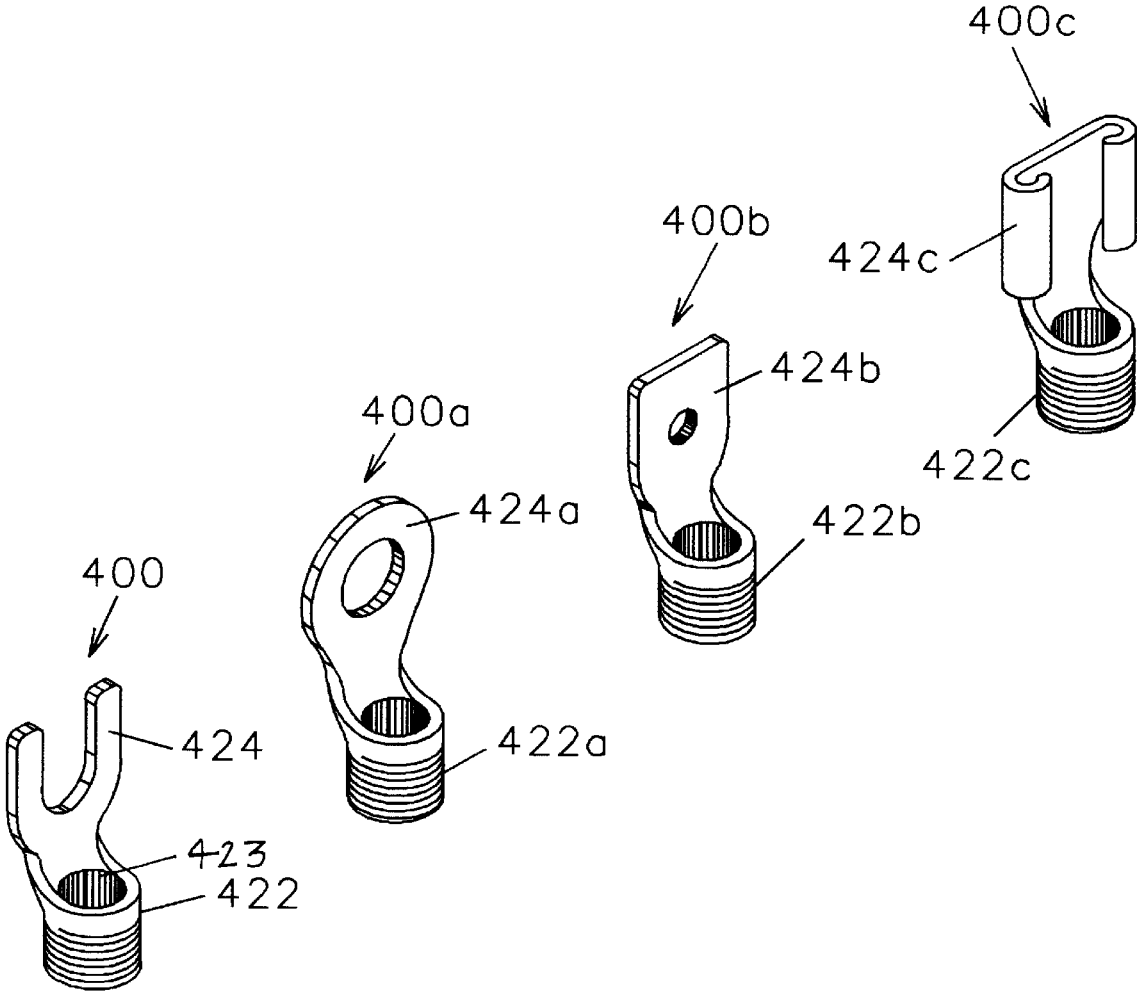
FIG. 6 is a perspective view showing a plurality of terminal lug assemblies of various designs for releasable engagement with the wire twist housing of FIG. 1.

Releasably engageable within the aperture 212 of housing 200 is a terminal lug assembly 400 having a threaded socket 422 attached to a lug 424. As shown in FIG. 6 the lug 424 may be of various configurations according to the type of downstream connection to be achieved. Upon positioning the socket 422 within the aperture 212, rotation of the socket 422 cause the threads of socket 422 to functionally engage the interior threads 240 of housing 200. During socket 422 rotation the interior bore 423 of the metal socket 422 contacts the metal twist housing 300 in a current-conducting relationship therebetween (see FIG. 7).

In use, two bare wire ends are first twisted about their ends and then inserted through the opening 222 and into the twist housing 300 via opening 320. The smaller end of the housing 300 will capture the ends of the initially twisted wire ends therein. Upon rotation of the housing 200 about imaginary center line axis, the captured, twisted wire ends will further twist about one another and be maintained in contact within the interior of the metal housing 300. Accordingly, a current flow path comprising the twisted wire ends, twist housing 300, socket 422 and terminal lug assembly 400 is presented. The lug 424 of the terminal lug assembly 400 is then connected to a downstream component terminal.

As shown in FIG. 6, various types of lugs 424, 424*a*, 424*b*, 424*c* may be used according to the type of terminal connection to be made.

Figure 8:
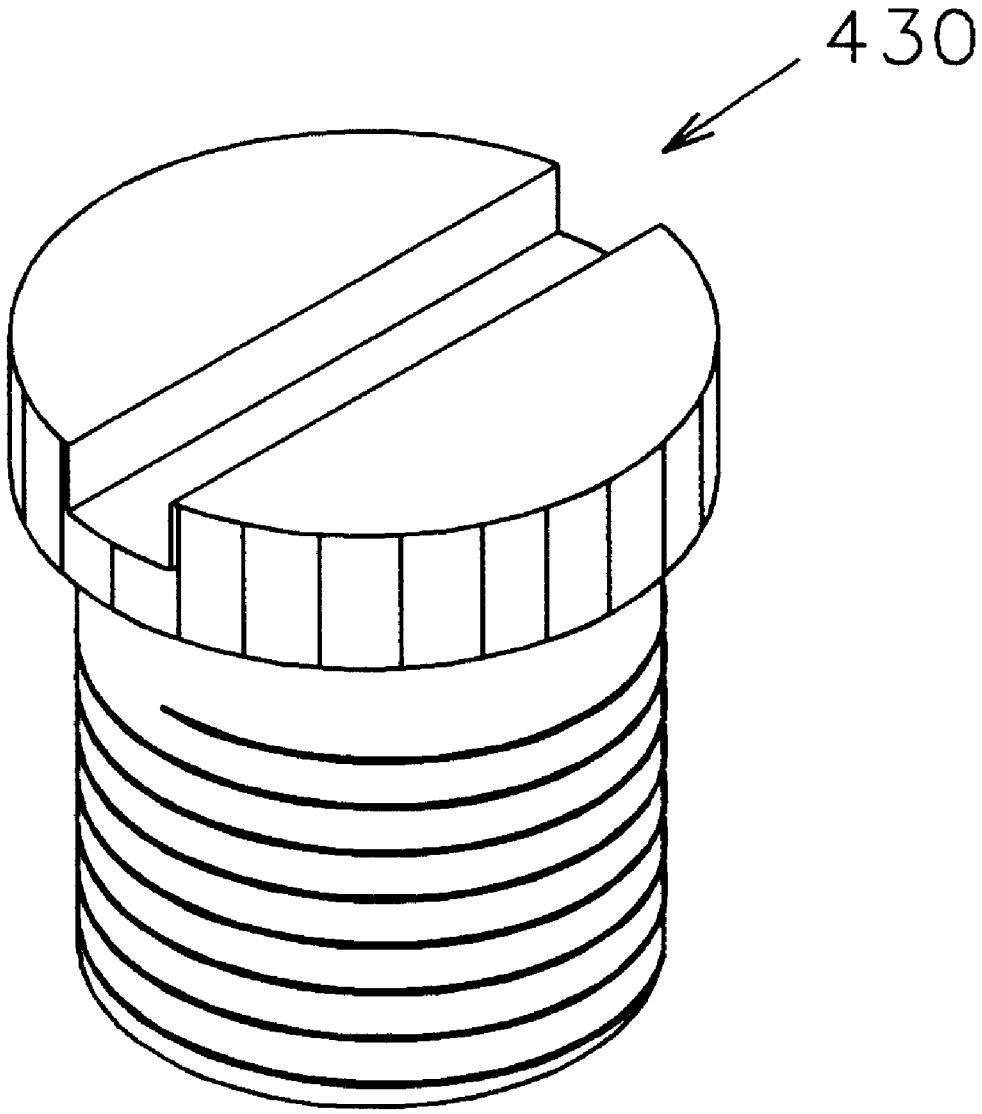
FIG. 8 is a perspective view showing an end cap for use in lieu of a terminal lug assembly.

Also, as shown in FIG. 8, an end cap 430 can be alternatively threaded within the aperture 212 of housing 200. End cap 430 may be used when only a twist connection of two wire ends is needed. Accordingly, the connector 100 as above described can be used in a first mode where current is to be conducted from the twisted wire ends to a downstream terminal and a second mode where current is to be connected through the twisted wire ends only.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A wire connector for joining a plurality of current-conducting wire ends comprising:

a first housing having first and second ends with a first opening at said first end adapted for insertion of at least first and second wire ends therethrough;

a second opening in said second end of said first housing;

a bore in said first housing extending between said first and second openings, said bore presenting an interior surface;

a second current conductive housing within said first housing, said second housing having: a bore presenting an interior surface, an opening to said second housing bore at a first end of said second housing adjacent said first opening of said first housing and a second end of said second housing adjacent said second end of said first housing, said second housing having an external configuration relative to said first housing bore presenting an exterior surface spaced from said first housing bore interior surface, said second housing adapted to twist the wire ends inserted through said second housing opening into conductive contact with said interior surface of said second housing bore upon rotation of said first housing about an imaginary vertical axis passing therethrough whereby to present a first current flow path between the twisted wire ends and said second housing;

a current conductive terminal lug;

socket means associated with said terminal lug for releasable engagement with said first housing bore surface and in conductive contact with at least a portion of said second housing exterior surface at a position spaced from said second end of said second housing, said second housing exterior surface thereby extending inside said socket means, whereby to present a second current flow path between said second housing, said socket engagement means and said terminal lug.

2. The connector as claimed in claim 1 wherein said socket means comprises a socket connected to said lug, said socket comprising a first exterior surface adapted for said engagement with said first housing bore surface; a bore in said socket and a second opposed interior surface about said socket bore, said second opposed interior surface for providing said contact with said second housing exterior surface.

3. The connector as claimed in claim 2 further comprising complementary fastener means on said socket first exterior surface and on said first housing bore surface for releasably fastening said socket within said first housing bore.

4. The connector as claimed in claim 3 wherein said complementary fastener means comprises:

a plurality of threads about said first exterior surface of said socket;

a plurality of threads about said bore surface of said first housing, said socket threads releasably engageable with said first housing threads to releasably fasten said socket in said first housing bore.

5. The connector as claimed in claim 2 wherein said second housing comprises a current conductive cone having said opening to said second housing bore for insertion of the wire ends therein, said cone configured to present said second housing exterior surface spaced from said first housing bore surface, a portion of said cone exterior surface extending into said socket bore and in conductive contact with said interior surface of said socket.

6. The connector as claimed in claim 5 wherein said cone comprises a wound coil of current conductive material.

7. The connector as claimed in claim 1 further comprising an end cap releasably engageable within said first housing second opening for closing said first housing second opening upon removal of said engagement means and associated terminal lug from said first housing.

8. A wire connector for joining a plurality of current-conducting wire ends comprising:

a first housing having first and second ends with an opening at said first end adapted for insertion of first and second wire ends therethrough and an opening at said second end;

a bore presenting an interior surface extending between said first housing openings;

current conduct means within said bore of said first housing for twisting the wire ends inserted through said first housing opening at said first end and into contact with said current conduct means upon rotation of said first housing about an imaginary vertical axis passing therethrough whereby to connect said wire ends, said current conduct means including an exterior surface displaced from said interior surface of said first housing bore;

a metal terminal lug assembly;

first and second complementary fastener means respectively on said first housing bore interior surface and on said assembly for releasably engaging said lug assembly with said first housing bore interior surface and in contact with said exterior surface of said current conduct means, said second fastener means on said lug assembly configured so that a portion of said exterior surface of said conduct means extends inside said second fastener means of said lug assembly and in conductive contact therewith upon insertion of said second fastener means into said first housing bore, whereby to present a current flow path between the wire ends in said current conduct means and connected to said terminal lug assembly.

9. The connector as claimed in claim 8 wherein said current conduct means comprises a metal housing within said first housing, said metal housing having a configuration for presenting said exterior surface displaced form said bore surface, a portion of said exterior surface of said metal housing inside said second fastener means on said lug assembly.

10. The connector as claimed in claim 9 wherein said conduct means configuration is a cone having an opening at a first end for insertion of the wire ends therein, a second opposed end of said cone extending inside said second fastener means on said lug assembly.

11. The connector as claimed in claim 8 wherein said first and second fastener means comprises:

a plurality of threads about said bore surface within said first housing;

a current conductive socket on said lug assembly adapted to fit within said first housing, said socket having threads for engagement with said first housing bore surface threads, said socket contacting said exterior surface of said current conduct means, a portion of said exterior surface extending inside said socket.

12. The connector as claimed in claim 8 further comprising an end cap releasably engageable with said first housing opening at said second end for closing said opening upon removal of said terminal lug assembly.

13. A wire connector system for joining a plurality of current-conducting wire ends into first and second current flow paths comprising:

a first housing having first and second ends with an opening at each end and a bore extending therebetween, said first end opening adapted for insertion of first and second wire ends therethrough;

a second metal housing fixed within said first housing, said second housing having a reduced configuration relative to said first housing to present a metal surface within said first housing spaced from an interior surface of said bore, said second housing having a configuration adapted to further twist the wire ends into contact with said second housing upon rotation of said first housing about an imaginary vertical axis passing therethrough whereby to present a first current flow path between said twisted wire ends;

a metal terminal lug;

socket means associated with said terminal lug, said socket means configured for a releasable insertion through said opening at said first housing second end and into said bore for a releasable, functional contact with said second metal housing for releasably conducting said lug with said second housing whereby to present a second current flow path between the wire ends, second housing and said terminal lug.

14. A wire connector for receiving a plurality of current-carrying wire ends comprising:

a first housing having first and second ends with an opening at said first end adapted for insertion of the wire ends therein;

an aperture in said second end of said housing;

a bore extending between said opening and said aperture;

a second current-conducting housing within said first housing, said second housing having an opening at a first end adjacent said first housing opening and a second end adjacent said aperture at said second end of said first housing, said second housing having a configuration adapted to receive the ends of the wires inserted through said second housing opening and to twist the ends of the wires into a current-conducting connection upon rotation of the first housing about an imaginary vertical axis passing therethrough, said second housing further configured to present a free longitudinally extending surface within said first housing bore;

a terminal lug having first and second ends;

means for releasably engaging said lug with said first housing upon extension of said engaging means through said aperture at said second end of said first housing and into said bore, said engaging means configured for surrounding said second housing surface in said first housing bore in a nested current conduct connection therebetween, said lug presenting means for a downstream electrical connection.

15. The connector as claimed in claim 14 further comprising an end cap for closing said first housing aperture upon removal of said releasable terminal lug.

* * * * *